US005864907A

United States Patent [19]

Hutton et al.

[11] Patent Number: 5,864,907

[45] Date of Patent: Feb. 2, 1999

[54] HANDLE STRUCTURE FOR A MATTRESS

[76] Inventors: William B. Hutton; Deanice B. Hutton, both of 330 Riverside Dr., St. Helens, Oreg. 97051

[21] Appl. No.: 911,632

[22] Filed: Aug. 15, 1997

[51] Int. Cl.[6] ..... A47C 31/08

[52] U.S. Cl. ..... 5/703; 5/737; 16/DIG. 28

[58] Field of Search ..... 5/703, 704, 737; 16/110 R, DIG. 28

[56] References Cited

U.S. PATENT DOCUMENTS 765,756 7/1904 Stratton ..... 5/703
897,979 9/1908 Holding ..... 5/703
1,731,530 10/1929 Goldeen et al. ..... 5/703

FOREIGN PATENT DOCUMENTS 402808 12/1933 United Kingdom ..... 5/703

*Primary Examiner*—Kenneth J. Dorner
*Assistant Examiner*—Robert G. Santos
*Attorney, Agent, or Firm*—Smith-Hill and Bedell

[57] ABSTRACT

A mattress border has two transverse stitched seams spaced apart lengthwise thereof. A strap has its two opposite end regions held in the two seams respectively.

10 Claims, 2 Drawing Sheets

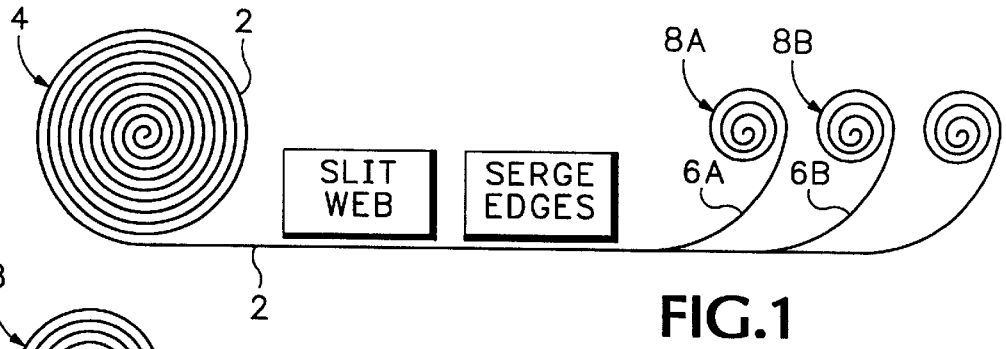
FIG.1
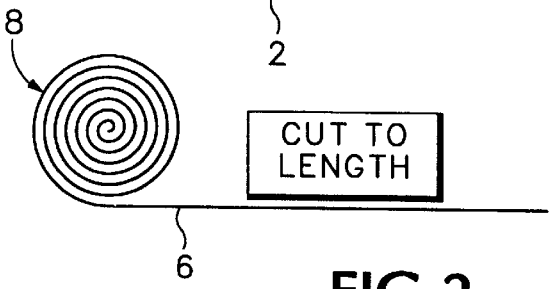
FIG.2
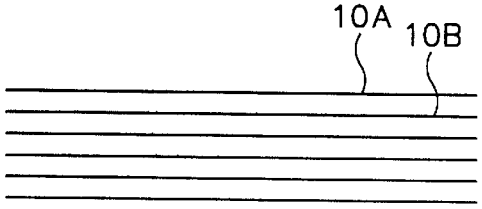
FIG.3A
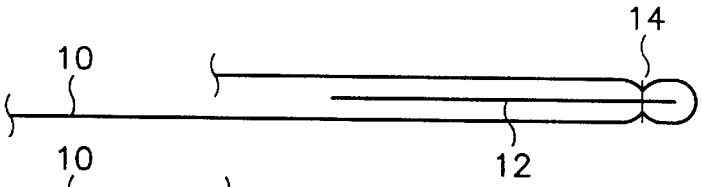
FIG.3B
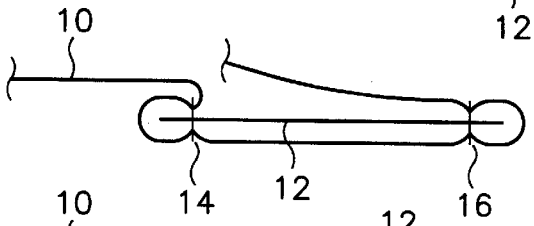
FIG.3C
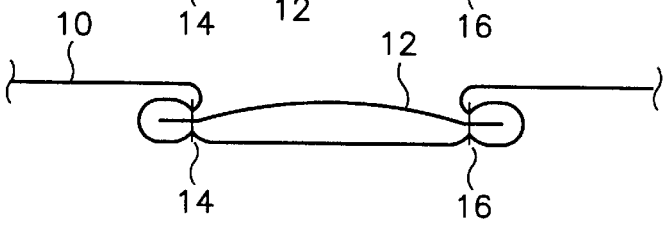
FIG.5
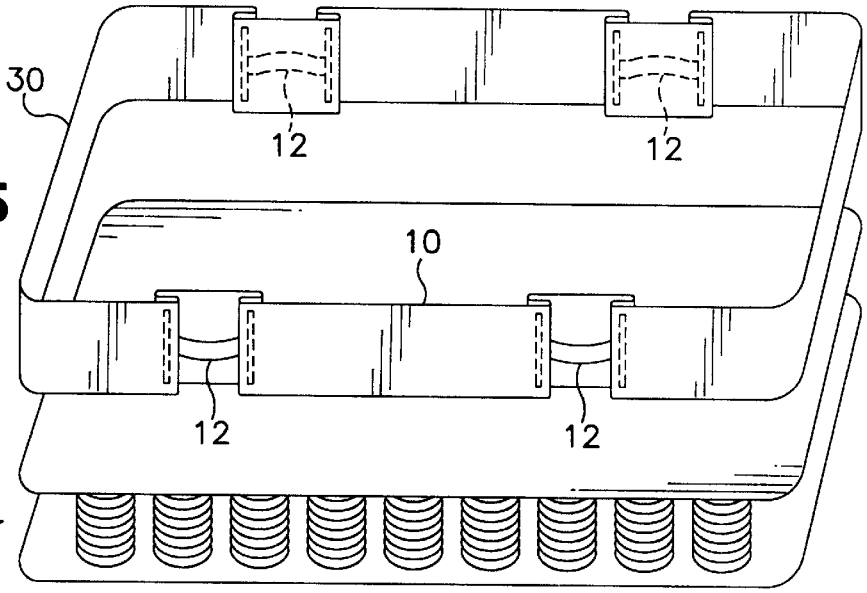

HANDLE STRUCTURE FOR A MATTRESS

BACKGROUND OF THE INVENTION

This invention relates to a handle structure for a mattress.

A conventional mattress, whether of twin, double, queen or king size, is generally parallelepipedal in form and has top and bottom surfaces and a peripheral wall. The top and bottom and the peripheral wall of the mattress are made of fabric known as tick. A decorative tape is used to bind the seams joining the wall to the top and bottom of the mattress.

It is conventional to attach handles to the wall of the mattress to facilitate lifting and turning of the mattress. A common form of handle is illustrated in U.S. Pat. No. 2,248,328 and comprises a flexible cord having a tubular ferrule at each end, each ferrule being provided with a projecting finger or barb. Two grommets are fitted in the mattress wall, about five inches apart and are linked by a backing bar of steel or tough synthetic polymer material. The tubular ferrules are inserted through the grommets respectively and are held in position by the barbs, which hook behind the grommets. The backing bar serves to protect the mattress wall from damage by the barb.

For many years, inner spring and foam mattresses were manufactured with a standard thickness of approximately seven inches. Recently, however, mattresses that are substantially thicker than seven inches, even up to about sixteen inches in thickness, have been manufactured in order to capture the luxury market, which is driven by demand for greater comfort and superior back support. Since the structure of the newer thicker mattress is the same as that of the older standard mattresses, the newer mattress contains much more material and accordingly the newer mattress is much heavier than the older standard mattress. Further, some mattresses are now made of a latex material and a mattress made of latex material can be substantially heavier than an innerspring or foam mattress of the same size and thickness.

The conventional type of handle, as described in U.S. Pat. 2,248,328 functions well with a mattress of the standard thickness and of conventional (innerspring or foam) construction but it may become detached from the wall of a heavier mattress when the mattress is lifted or turned. Further, the cord of the conventional handle tends to dig into the hand of the person lifting or turning the mattress, and in the case of a heavier mattress, this may cause discomfort and even injury.

In order to alleviate the problems of the conventional handle, it has been proposed that a mattress handle should be made from a strip of fabric having two end regions by which the strap is sewn securely to the mattress wall. In a particular instance of this type of handle, the end regions of the strap are square in configuration and each end region is sewn to the mattress wall along all four sides of the square, along the two diagonals and along a line midway between the upper and lower sides of the square. This type of handle, and its manner of attachment, overcome the disadvantages of the conventional handle. However, it has proven impractical to automate the operation by which the handle is placed on the mattress wall and the end regions of the handle are sewn to the mattress wall and therefore it is necessary for an operator to position the strap and guide the sewing machine head along the desired path. Consequently, it is expensive and time consuming to attach the handle to the mattress wall by sewing in accordance with the pattern described above.

SUMMARY OF THE INVENTION

In accordance with a first aspect of the invention there is provided a mattress border structure comprising a mattress border having first and second transverse stitched seams spaced apart lengthwise thereof, and a strap having first and second opposite end regions held in the first and second seams respectively.

In accordance with a second aspect of the invention there is provided a mattress structure comprising a mattress top, a mattress bottom, a border joining the mattress top and mattress bottom and having first and second stitched transverse seams spaced apart lengthwise thereof, and a strap having first and second opposite end regions held in the first and second transverse seams respectively.

In accordance with a third aspect of the invention there is provided a mattress border structure comprising a mattress border having first and second folds spaced apart lengthwise thereof, a strap having first and second opposite end regions received in the first and second folds respectively, and first and second transverse lines of stitching closing the first and second folds respectively and traversing said first and second end regions respectively, whereby the first and second end regions are held in the first and second folds respectively.

In accordance with a fourth aspect of the invention there is provided a mattress structure comprising a mattress top, a mattress bottom, a border joining the mattress top and mattress bottom and having first and second folds spaced apart lengthwise thereof, a strap having first and second opposite end regions received in the first and second folds respectively, and first and second transverse lines of stitching closing the first and second folds respectively and traversing said first and second end regions respectively, whereby the end regions are held in the folds respectively.

In accordance with a fifth aspect of the invention there is provided a method of making a border for a mattress, comprising receiving a length of border material, and forming first and second transverse stitched seams in the length of border material with first and second end regions of a strap in the first and second seams respectively.

In accordance with a sixth aspect of the invention there is provided a method of making a mattress having top and bottom surfaces and a peripheral border which connects the top and bottom surfaces, comprising the steps of providing a length of border material, forming first and second stitched seams in the length of border material with first and second end regions of a strap in the first and second seams respectively, providing an assembly composed of a mattress top and a mattress bottom, and fitting the length of border material to the assembly.

In accordance with a seventh aspect of the invention there is provided a method of making a border for a mattress, comprising receiving a length of border material, forming first and second folds in the length of border material with first and second end regions of a strap in the first and second folds respectively, closing the folds with first and second transverse lines of stitching which traverse the first and second end regions respectively, whereby the end regions are held in the folds respectively.

BRIEF DESCRIPTION OF THE DRAWINGS

For a better understanding of the invention, and to show how the same may be carried into effect, reference will now be made, by way of example, to the accompanying drawings, in which FIG. 1 is a partial schematic illustration of a first part of a production line for manufacture of mattresses, FIG. 2 is a partial schematic illustration of a second part of a production line for manufacture of mattresses, FIGS. 3A, 3B and 3C illustrate respective steps of a technique for attaching a strap to a mattress border to form a handle, FIG. 5 illustrates a step in assembly of a mattress.

DETAILED DESCRIPTION

Figure 4:
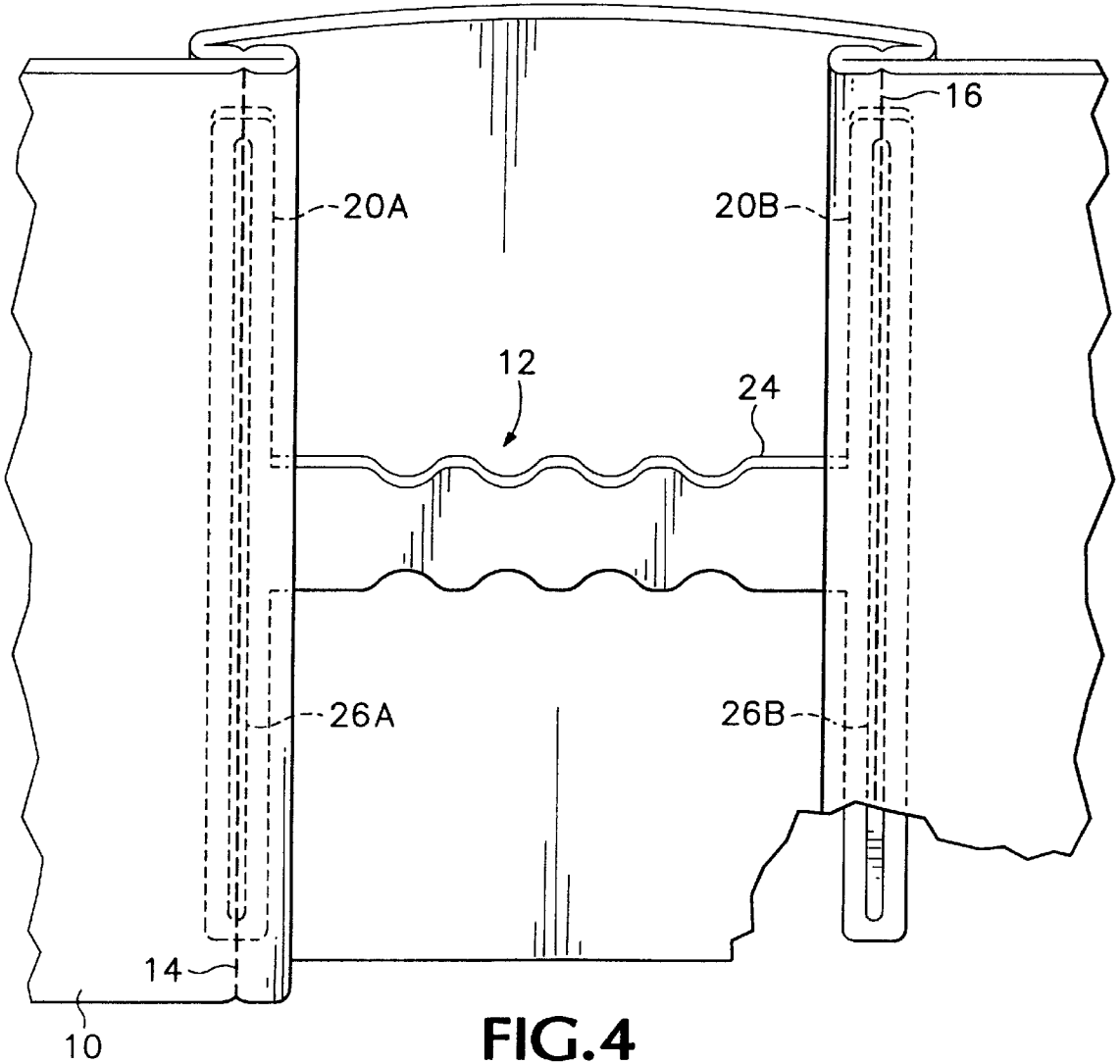
FIG. 4 is an enlarged view of a preferred form of strap.

Referring to FIG. 1, a broad web 2 of border material wound on a roll 4 is unwound and the web is slit longitudinally into several strips 6A, 6B, etc. and the edges of each strip are serged to limit fraying of the strips and the possibility of a loose thread being caught in the machinery used for subsequent processing of border material. The strips of serged border material are wound onto rolls 8A, 8B, etc. Each roll 8 is delivered to an unwinding station (FIG. 2), at which the strip 6 of border material is unwound and cut into several segments 10A, 10B, etc. The length of each segment 10 is suitable for forming the border of one mattress and depends on the size of mattress that is to be made (twin, full, king or queen). Each segment 10 is passed to a stitching station at which a fold is formed in the segment. A strap 12 (FIG. 3A) is positioned with one end region in the fold and the fold is closed a short distance from the deepest point of the fold, by a single line of stitching 14 extending across the strip 10 and capturing the end region of the strap in the fold. A similar fold is formed at the opposite end of the strap and is closed in similar fashion by a line of stitching 16 (FIG. 3B). In this manner, the strap is secured firmly to the segment 10 of border material and forms a handle (FIG. 3C).

The strap may be made of tick, in which case it may be of uniform width and is preferably of the same pattern as the border material. However, it is preferred that the strap be made of synthetic polymer material, such as polypropylene, polyethylene or PVC, in which case the strap has a medial portion or bar 24 of generally uniform width and two parallel flanges 20A and 20B at opposite respective ends of the bar 24 and is therefore generally H shaped in plan, as shown in FIG. 4. Each flange 20 has a peripheral rim of relatively thick material, e.g. at least about one-eighth inch, surrounding a membrane 26 of substantially thinner material, e.g. one-sixteenth inch or less. The upper end surface and lower end surface of each flange 20 are rounded, and there are rounded transitions between the peripheral rim and the membrane 26. The bar 24 between the parallel flanges 20 is rather thicker than the flanges and is shaped to receive the fingers of a person gripping the handle.

In fitting the strap shown in FIG. 4 to a length segment 10 of the border material, the segment of border material is folded, as described above, and the flange 20A is placed in the fold. The line of stitching 14 is then made across the segment, the membrane 26A being aligned with the path of the needle so that the stitching penetrates the membrane and the border material is stitched into the recess surrounded by the peripheral rim of the flange. The sewing machine is controlled so that the stitching jumps the two ends of the flange. The opposite end of the strap is fitted to the length segment 10 in similar fashion, by stitching through the membrane 26B of the flange 20B. By stitching through the membrane, which although thin is nevertheless tough, the flanges are held securely to the length segment of border material. Three more straps 12 are attached to the length segment 10 of border material and the two ends of the segment are stitched together to form an endless band 30 (FIG. 5). The band 30 is delivered to a station at which it is fitted to a subassembly 34 comprising a mattress top and bottom and a mattress interior, such as metal springs or a suitable springy block of polymer material. The band is sewn along its edges to the peripheries of the mattress top and bottom and strips of decorative tape are sewn along the seams at which the band meets the mattress top and bottom, thus completing a mattress.

When the mattress is lifted using handles formed from straps of the type shown in FIG. 4, there may be a slight tendency for the flanges 20 to move upward relative to the border material in the respective folds. The flanges may contact the thread by which the strap is attached to the border material, but because the peripheral rims of the flanges are rounded, there is very little possibility of damage to the threads.

In a modification of the strap shown in FIG. 4, the membranes 26 are omitted, so that the rims of the flanges surround respective slots. The stitching passes through each slot and the border material is stitched into the slot.

The decorative tape that is used to bind the seams between the border material and the top and bottom of the mattress is generally uniform in color, i.e. unpatterned, and relatively few colors are commercially used. In the event that the strap 12 is made of synthetic polymer material, for as described with reference to FIG. 4, it is preferred that the strap 12 be uniform in color and that the color of the strap be coordinated with the tape. For example, the strap may be substantially the same color as the tape or it may be a complementary color.

It will be appreciated that the invention is not restricted to the particular embodiment that has been described, and that variations may be made therein without departing from the scope of the invention as defined in the appended claims and equivalents thereof.

We claim:

1. A mattress border structure comprising an elongate mattress border having first and second folds extending transversely of the elongate mattress border and spaced apart lengthwise thereof, a strap having first and second opposite end regions received in the first and second folds respectively, and first and second lines of stitching closing the first and second folds respectively, the first and second lines of stitching extending transversely of the elongate mattress border and traversing said first and second end regions respectively, whereby the first and second end regions are held in the first and second folds respectively.

2. A mattress structure comprising a mattress top, a mattress bottom, an elongate border joining the mattress top and mattress bottom and having first and second folds extending transversely of the elongate border and spaced apart lengthwise thereof, a strap having first and second opposite end regions received in the first and second folds respectively, and first and second lines of stitching closing the first and second folds respectively, the first and second lines of stitching extending transversely of the elongate border and traversing said first and second end regions respectively, whereby the end regions are held in the folds respectively.

3. A method of making a mattress having top and bottom surfaces and a peripheral border which connects the top and bottom surfaces, comprising the steps of:

providing a length of border material, forming first and second folds in the length of border material, the first and second folds extending transversely of the length of border material, placing first and second end regions of a strap in the first and second folds respectively, closing the folds with first and second lines of stitching which extend transversely of the length of border material and traverse the first and second end regions respectively, whereby the end regions are held in the folds respectively, providing an assembly composed of a mattress top and a mattress bottom, and fitting the length of border material to the assembly.

4. A method of making a border for a mattress, comprising:

receiving a length of border material, forming first and second folds in the length of border material, the first and second folds extending transversely of the length of border material, placing first and second end regions of a strap in the first and second folds respectively, closing the folds with first and second lines of stitching which extend transversely of the length of border material and traverse the first and second end regions respectively, whereby the end regions are held in the folds respectively.

5. A mattress border structure comprising a mattress border having first and second transverse stitched seams spaced apart lengthwise thereof, and a strap having a medial bar and first and second flanges which extend transversely of the medial bar and are held in the first and second seams respectively, and wherein each flange has a slot extending transversely of the medial bar and the first and second seams pass longitudinally through the slots in the first and second flanges respectively.

6. A structure according to claim 5, wherein the strap is made of synthetic polymer material.

7. A structure according to claim 6, wherein the strap is made of polyethylene, polypropylene or polyvinyl chloride.

8. A mattress border structure comprising a mattress border having first and second transverse stitched seams spaced apart lengthwise thereof, and a strap having a medial bar and first and second flanges which extend transversely of the medial bar and are held in the first and second seams respectively, wherein each flange has a peripheral rim surrounding a membrane and the first and second seams pass longitudinally through the membranes in the first and second flanges respectively.

9. A structure according to claim 8, wherein the strap is made of synthetic polymer material.

10. A structure according to claim 9, wherein the strap is made of polyethylene, polypropylene or polyvinyl chloride.

* * * * *